US006578483B2

(12) United States Patent
Compera et al.

(10) Patent No.: US 6,578,483 B2
(45) Date of Patent: Jun. 17, 2003

(54) DEVICE FOR ASSEMBLY OF TUBULAR CARRIER ELEMENTS

(75) Inventors: Christian Compera, Schönau (DE); Wolfgang Heinrich Alberstadt, Stockstadt am Rhein (DE)

(73) Assignee: NexPress Solutions LLC, Rochester, NY (US)

( * ) Notice: Subject to any disclaimer, the term of this patent is extended or adjusted under 35 U.S.C. 154(b) by 24 days.

(21) Appl. No.: 09/850,045

(22) Filed: May 7, 2001

(65) Prior Publication Data

US 2002/0007745 A1 Jan. 24, 2002

(30) Foreign Application Priority Data

May 12, 2000 (DE) ..... 100 23 152

(51) Int. Cl.[7] ..... B41F 27/00
(52) U.S. Cl. ..... 101/375; 101/378; 101/479
(58) Field of Search ..... 101/479, 375, 101/376, 401.1, 216; 492/27, 28, 30, 60

(56) References Cited

U.S. PATENT DOCUMENTS 4,030,415 A * 6/1977 Fellows ..... 101/382.1
4,089,265 A * 5/1978 White et al. ..... 101/375
4,150,622 A * 4/1979 Stollenwerk et al. ..... 101/378
4,217,821 A * 8/1980 Vertegaal et al. ..... 101/118
4,903,597 A * 2/1990 Hoage et al. ..... 101/375
5,062,193 A * 11/1991 Thompson ..... 29/235
5,649,267 A 7/1997 Aerens et al.
5,735,206 A * 4/1998 Rossini ..... 101/216
5,889,544 A * 3/1999 Mey et al. ..... 101/489
6,283,026 B1 * 9/2001 Tocheport et al. ..... 101/375
6,357,354 B1 * 3/2002 Dauer et al. ..... 101/375
6,401,613 B1 * 6/2002 Gayle et al. ..... 101/375
6,401,614 B1 * 6/2002 Venturati ..... 101/153

FOREIGN PATENT DOCUMENTS

WO 91/01845 2/1991
WO 96/20835 7/1996

* cited by examiner

*Primary Examiner*—Andrew H. Hirshfeld
*Assistant Examiner*—Kevin D. Williams
(74) *Attorney, Agent, or Firm*—Lawrence P. Kessler

(57) ABSTRACT

The invention concerns a device for assembly of tubular cylindrical carriers (8) on the circumference (22) of carrier cylinders (1) of drums or cylinders, wherein for the assembly of the tubular carrier (8) on the lateral surface (22) a pressure medium acts upon the latter. By attaching an assembly aid (4), on which a tubular carrier (8) can be held, on the carrier cylinder (1), a pressure medium acts upon the latter, so that positioning of the tubular carrier (8) is made possible.

13 Claims, 3 Drawing Sheets

DEVICE FOR ASSEMBLY OF TUBULAR CARRIER ELEMENTS

FIELD OF THE INVENTION

The present invention relates to a device for assembly of tubular carrier elements, for example tubular channelless carriers, on the circumference of which a functional layer can be made in the form of a photoelectric layer.

BACKGROUND OF THE INVENTION

U.S. Pat. No. 5,215,013 refers to device for noise damping in the case of covering the peripheral area of a press cylinder with a tubular rubber blanket. This device preferably is used on the press of an offset press, which is equipped with channelless press cylinders. The rubber blanket is expandable in the circumferential direction, for which a pneumatically generated pressure can act on the inside of the rubber blanket sleeve. Then the expanded rubber blanket sleeve is pushed laterally over the surface of the cylinder. The rubber blanket sleeve is provided with a damping ring for damping the noise, which is caused by the lateral emergence of the compressed air. The high-frequency noise, generated by oscillations of the rubber blanket sleeve which is under pressure, is damped by the damping ring. The cylinder surface is provided with exit holes, which create and maintain the air cushion at the time of pursing the rubber blanket sleeve over the surface of the cylinder, at the place at which the rubber blanket sleeve is set laterally on the cylinder surface for pushing.

U.S. Pat. No. 5,649,267 refers to a cylinder arrangement which can be used in a press unit. An essentially tubular element, on the surface of which a toner image can be generated, is used on the cylinder arrangement which is made essentially drum-shaped. The drum surface includes open ends, the flat sides of which are supported by disk-like peripheral areas supporting the lateral surface. The flat sides, with which the openings of the cylindrically configured surface can be closed, are cooled before assembly, in order then to be let into the openings of the surface. The flat sides, which are shrunken into the cylinder surface ends in this way, in this case are provided with shaft bearings. A shaft passing through the drum arrangement in the axial direction is received in the shaft bearings. The eccentricity of the drum casing can be preset relative to the rotation axis by the adjustment screws provided on the flat sides.

In the case of electrographic press units, wear of the functional layer takes place on cylinders, the surface of which can be provided with a functional layer, for example a photoelectric layer. This wear of the functional layer makes replacement of the functional layer necessary. In order to be able to perform the replacement, the sleeve which holds the functional layer in each case is changed inside or outside the press unit. In this case a positionally correct pushing of the cylinder sleeve carrying the functional layer is mandatory.

SUMMARY OF THE INVENTION

In view of the solutions known from the prior art and the technical problem indicated, the object of the invention is to make reliable assembly of a cylinder covering on a carrier cylinder possible.

According to the invention this object is achieved by the features of Patent claim 1.

The advantages resulting from the solution proposed according to the invention are to be seen above all in the fact that the covering to be applied can be positioned laterally almost seamlessly on the surface of the carrier cylinder by setting the assembly aid on a flat side of the carrier cylinder. The air cushion generated by a pressure medium, supporting the process of mounting the tubular carrier, is created only when the assembly aid is positioned on the stop surface of the carrier cylinder correspondingly provided therefor. The surface of the tubular carrier to be mounted is protected effectively on the assembly aid, since a cover overlapping the surface of the covering tubular carrier is provided.

In a further configuration of the concept on which the invention is based, in each case switch elements for switching the pressure medium on and off can be provided on the carrier cylinder or in the assembly aid. This assures that the pressure medium is applied only when it is also actually necessary, namely during the process of positioning the tubular carrier to be applied laterally onto the surface of the carrier cylinder.

The circumstance that the action of exit openings for the pressure medium in each case exerted on the peripheral surface of the assembly aid and on the circumference of the carrier cylinder takes place only when assembly aid and carrier cylinder lie against one another on a stop surface is particularly advantageous. The correct arrangement of the assembly aid on the carrier cylinder can be achieved by having one of the bearing pins of the carrier cylinder serve as a centering element. The bearing pin serving as a centering element works together with a receptacle provided inside the assembly aid, which in a preferred configuration can be made as a hole extending along the rotation axis of the assembly aid and the carrier cylinder. The receptacle can be made both parallel to the rotation axis of the assembly aid and the centering element; the receptacle can be made just as well coaxial to the rotation axis of the carrier cylinder and assembly aid. In order to assure the centering of the assembly aid on the bearing surface of the carrier cylinder, the receptacle can be provided with an opening on a flat side, in which an end of the bearing pin functioning as a centering element can be received. The accuracy and duration of the centering is increased significantly by having the receptacle overlap the end of the bearing pin with a covering area, so that the centering of the assembly aid can be maintained while it lies tight against the bearing surface. The assembly aid includes an outlet opening into its lateral surface for a pressure medium, wherein the latter opens in particular in an area under cover protecting the tubular carrier. A ring slot extending over the axial length is made between the lateral surface of the assembly aid and the cover for protecting the surface or the tubular carrier.

In order to assure that the pressure medium acting on the carrier cylinder and assembly aid can be switched on and off in the case of axial positioning of the tubular carrier, an operating element is made on the assembly aid. The operating element, for example made as a pin, penetrates a flat side of the carrier cylinder in the case of contact of the assembly aid with a bearing surface on the carrier cylinder, and causes a pressure medium to flow out into the corresponding outlet openings on the lateral surface of carrier cylinder and assembly aid.

The operating element made, for example, as a pin can be operable also in the axial direction; operation of the same in the radial direction is equally well conceivable. In the case of pin-shaped configuration of the operating element provided on the assembly aid the latter penetrates the flat side in the case of installation of the assembly aid on a bearing pin of the carrier cylinder and corresponding centering by holding on a bearing pin of the carrier cylinder in such a way that the end of the operating element is in contact with a conical switch element, which operates a valve provided with the carrier cylinder. The pressure provided via a pressure medium line is directed into the carrier cylinder opening via a connection through the bearing pin turned away from the bearing surface onto the surface of the carrier cylinder and assembly aid. In addition, outlet openings are made in the mounting area of assembly area and carrier cylinder, which both open into the hole which is penetrated by the operating element and into which the pressure medium flowing out from the pressure line released by the valve arrangement in the carrier cylinder opens and which acts upon the peripheral surfaces of the two components mentioned.

The device proposed according to the invention advantageously can be used in a press with which both a web-like printing material as well as a printing material in sheet form can be printed on one or both sides. The press can be part of a printing press, which contains one or more presses, a toner image being generated on the lateral surface of the channelless tubular carrier form to be mounted.

BRIEF DESCRIPTION OF THE DRAWING

The invention is explained in greater detail below by reference to the drawing.

Here.

DETAILED DESCRIPTION OF THE INVENTION

Figure 1:
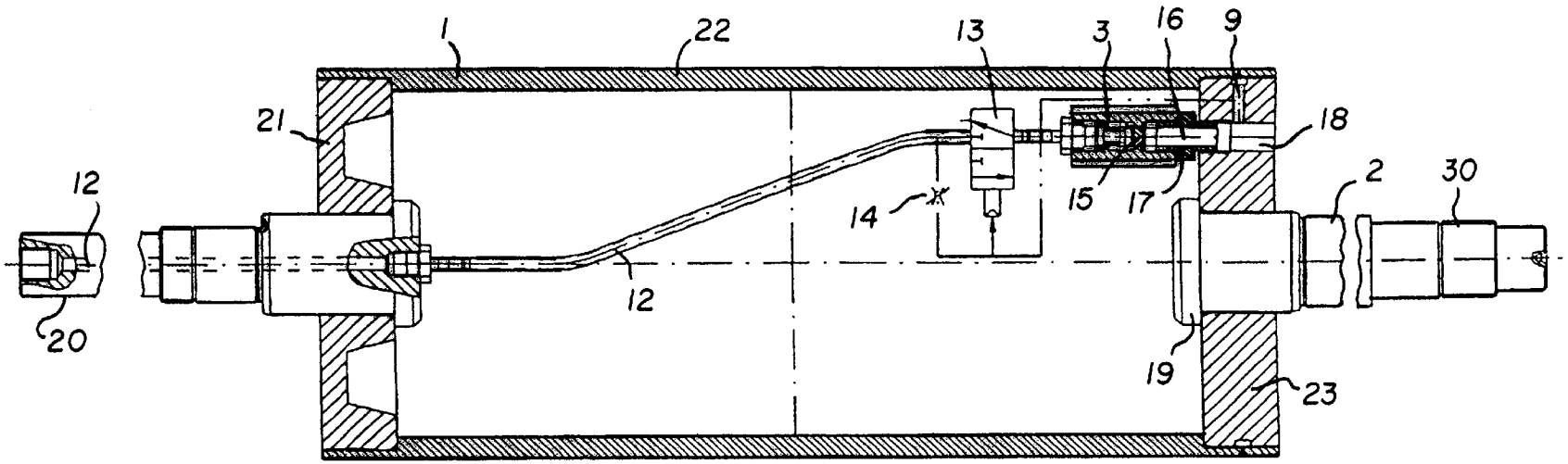
FIG. 1 shows a longitudinal section through a carrier cylinder arrangement with a switch valve held in the interior for the pressure medium supplied on the bearing pin side.

It follows from the presentation according to FIG. 1 that there is a carrier cylinder with bearing pins in each case held on the flat sides, through the interior of which a supply line of a pressure medium extends up to a valve arrangement.

The carrier cylinder 1, made essentially rotation-symmetrical to its rotation axis, contains two bearing pins 2 and 20, of which bearing pin 2 serves as a centering pin. In its interior, which is bounded by flat surfaces 21, and 23, there is a switch element 3, which can be made, for example, as a pneumatic switch element. Between switch element 3 and a pressure medium supply line 22 there is a valve arrangement 13, which functions essentially as a two-way valve arrangement. An adjustable throttle element 14 is associated with the valve arrangement 13. The throttle element 14 serves to enable pressure in an outlet opening 9, which opens into a lateral surface 22 of the carrier cylinder 1, to be removed.

A conical operating element 15, aligned with a spacer 17, in which a hole 16 is formed, is located in operative association with the pneumatically operating switch element 3. The hole 16 in the spacer 17 essentially aligns with the hole 18 in the flat surface 23 and is, for example, screwed into the latter via a thread. The bearing pin 2 of the carrier cylinder functioning as a entering pin is held on the flat surface 23 and fits against the inside of the flat surface via a collar 19 carried by the carrier cylinder. A mounting surface, serving as a centering surface, for the collar 19 is a thread on the centering pin 2.

On the opposite bearing pin 20 of the carrier cylinder 1, according to the invention, a supply line 12 of a pressure medium is essentially coaxial, with the bearing pin and penetrates the carrier cylinder 1. The pressure medium supply line can be passed through to carrier cylinder as a compressed air line with an end in juxtaposition with the valve arrangement 13.

The lateral surface 22 of the carrier cylinder 1 is, as shown in FIG. 1, a channelless uninterrupted peripheral area, onto the circumference of which a tubular carrier 8 (not shown in FIG. 1) can be pushed and positioned. For example, the tubular carrier 8 can be a cylinder sleeve, on the surface of which an electrographic layer can be formed. A toner image can be created on the electrographic layer according to the electrography principle.

Instead of an uninterrupted bearing piece penetrating the carrier cylinder 1 penetrating from flat surface 23 to flat surface 21, in the presentation according to FIG. 1, the bearing, centering pins 2, and 20 are mounted as pins, in each case in their flat sides 21, respectively 23. This produces an open space within the cavity of the carrier cylinder 1, in which the switch element 3, the valve arrangement 13, as well as the adjustable throttle 14 and the pressure medium supply line 12 extending from the bearing pin 20 can be held.

Figure 2:
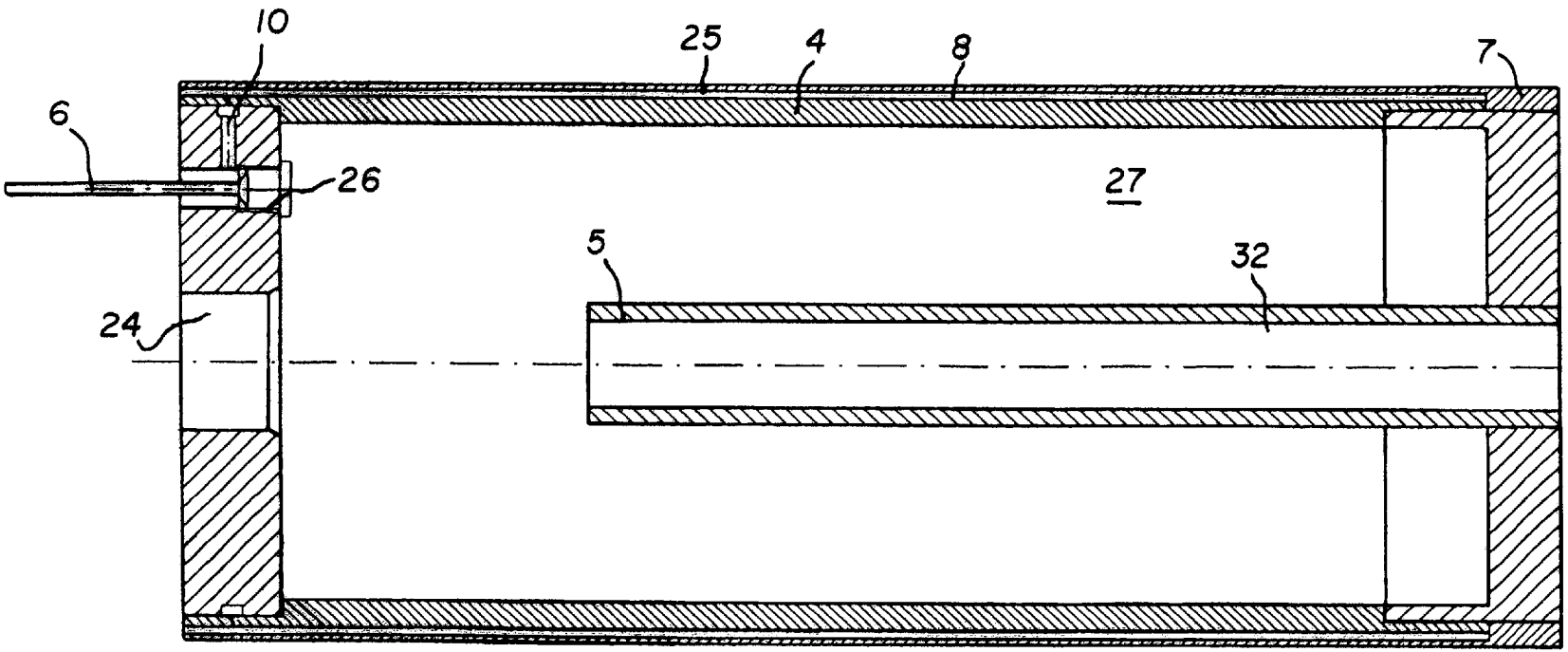
FIG. 2 shows a longitudinal section through a mounting aid with a receptacle made coaxial to the axis of rotation of the assembly aid and in which with a pin-shaped operating element held on the flat side, for example screwed in here, for the switch arrangement of a carrier cylinder.

According to the representation shown in FIG. 2, there is a longitudinal section through the assembly aid proposed according to the invention, through which a receptacle 5 passes coaxial to the rotation axis.

From the representation showing in FIG. 2 it follows that the assembly aid 4 essentially is a lateral surface 34 and two flat surfaces 35 and 36. In the flat surface 35, which is located opposite an operating element 6, a receptacle 5 is mounted coaxial to the rotation axis of the assembly aid 4. The receptacle 5 extends essentially over more than half of the axial extent of the assembly aid 4. The receptacle 5 is penetrated by a hole 32 extending axially. The operating element 6 secured to the flat surface 35, opposite the end of the receptacle 5, is a pin which extends through a hole **6*a* outwardly of the assembly aid 4. An outlet hole 10, which opens into the lateral surface 34 of the assembly aid 4, branches from the hole 6*a*. In addition to the pin-shaped configuration of the operating element 6 shown, it can also be made in different shapes. In the flat surface 35 receiving the operating element 6 (here shown as a pin) there is also an opening 24 (see FIG. 3), which can be penetrated by the bearing pin 2 of the carrier cylinder 1, accordingly functioning as a centering pin. The end opening 28 of the receptacle 5 is located opposite the receiving hole 24 in the flat surface 35 to receive the free end 29 of the bearing pin 2**.

A tubular carrier 8 can be held on the circumference of the assembly aid 4, in a ring slot 25, bounded by the lateral surface 34 of the assembly aid 4 and a protective covering 7 extending coaxial hereto. The surface of this tubular carrier, for example a photoelectrically sensitive coating, is effectively protected with this covering 7 against external influences such as scratching, contact, or wetting with liquids or fluids, and therefore is very extensively shielded against external influences in the case of handling.

Figure 3:
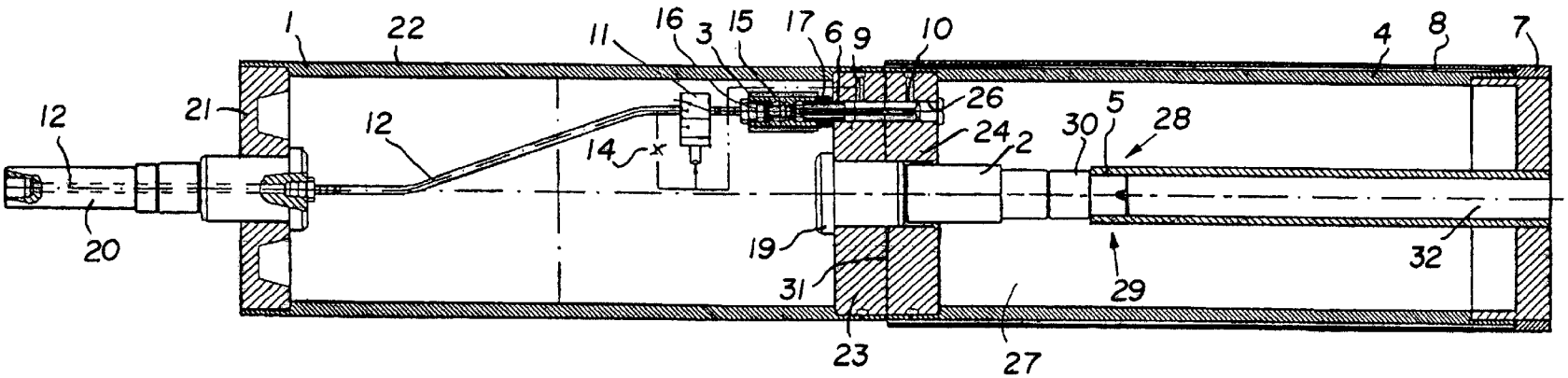
FIG. 3 shows the assembly aid centered on a bearing pin of the carrier cylinder, carrier cylinder and assembly aide lying against one another on a bearing surface and the operating element acting on a pendant on the switch valve for releasing the pressure medium.

An assembly aid 4, which is supported on bearing pin 2 and centered relative to flat surface 23, (functioning as a thrust_bearing surface 31), follows from the representation according to FIG. 3.

From the representation shown in FIG. 3, it follows that the assembly aid 4 lies against the flat surface 23 of the carrier cylinder 1. The bearing pin 2 extending from the flat surface 23, from the collar 19 on the inside of the flat surface 23, functions as a centering pin in this representation. The bearing pin 2 is pushed with its narrowed projection end 29 into the end opening 28 of the receptacle 5, which penetrates the assembly aid 4 coaxially to the rotating axis thereof.

The centering of the assembly aid 4 takes place essentially by introducing the narrowed end 29 of the bearing pin 2 into the receptacle receiving hole 18 of the receptacle 5.

In this way it is assured that the operating element 6 (pin-shaped element) penetrates the hole 6*a* in the flat surface 35 of the assembly aid 4 containing the receiving hole 24, and is aligned with and enters the hole 18 penetrating the flat surface 23 of the carrier cylinder 1. This hole 18 opens (see representation according to FIG. 1) into the hole 16 of the spacer 17, which lies opposite the conical operating element 15 of the pneumatic switch element 3. If the pin-shaped operating element 6 comes in contact with the surface of the conical operating element, the valve arrangement 13 in the interior of the carrier cylinder 1 is operated and releases the feed of a pressure medium into the outlet openings 9 and 10. There is a sensor (not shown) in the outlet opening 9, which is provided on the flat surface 23 of the carrier cylinder 1. The sensor responds to the presence of a tubular carrier 8 to be pushed over the lateral surface 22 by an attached assembly aid 4 and switches the valve arrangement via the throttle element 14 in such a way that the latter is brought to a volume flow for generating a force sufficient to enable pushing the tubular carrier 8 onto the lateral surface 22. As soon as the air cushion is formed, the tubular carrier 8 is moved onto the lateral surface 22 of the carrier cylinder 1.

In this way the tubular carrier 8, still enclosed by the covering 7, is easily expanded by the formation of an air cushion and can be pushed laterally onto the lateral surface 22 of the carrier cylinder 1. By the seamless transition between the lateral surface of the assembly aid 4, with the lateral surface 22 of the carrier cylinder 1, a slight expansion of the tubular carrier is sufficient to enable the tabular carrier to be pushed laterally onto the lateral surface 22 of the carrier cylinder 1. The air cushion forming on the assembly aid 4, generated by the outlet opening 10, enables the tabular carrier to be advanced seamlessly onto the lateral surface 22 of the carrier cylinder 1. The outlet opening 9 (provided in the flat surface 23), which opening is acted upon by the pressure medium flowing into the hole 18, supports the formation of an air cushion on the lateral surface 22 of the carrier cylinder 1 under the tubular carrier element 8.

By attaching the assembly aid 4 to the carrier cylinder 1 first (i.e., before trying to mount the tubular carrier 8 on the carrier cylinder), there is a contact of the operating element 6 with the conical operating element 15 of the valve arrangement 13 so that the pressure medium can be provided only when it is needed for covering the lateral surface 22 of the carrier cylinder 1 with the tubular carrier. During the lateral positioning of the tubular carrier 8 on the lateral surface 22 of the carrier cylinder 1, the centering of the peripheral surfaces of the assembly aid 4 and carrier cylinder 1 is ensured by enclosing the bearing pin of the carrier cylinder 1 (centering pin 2) effectively by the receptacle 5 in the assembly aid 4 and maintaining the centering. In this way an alignment of the flat surface 35 of the assembly aid 4 with the flat surface 23 during the lateral positioning of the tubular carrier 8.

The adjusting of the valve arrangement 13 to control compressed air volume flow can be controlled by equipping the outlet opening 9 in the flat surface 23 with a sensor element. As soon as the tubular carrier 8 passes from the lateral surface of the assembly aid 4 to the lateral surface 22 of the carrier cylinder 1, the sensor in the outlet opening 9 detects this passage and increases the volume flow via the adjustable throttle element 14 from a first volume flow to a second stronger volume flow. In this way an air cushion, which permits a lateral displacement of the tubular carrier 8 from the assembly aid 4 onto the lateral surface 22, is formed under the tubular carrier 8 to be installed. If the tubular carrier 8 has reached its position and the assembly aid 4 centering pin 2 is removed from the assembly aid, the pin-shaped operating element 6 emerges from the hole 18 and releases the conical operating element 15. In this way the compressed air volume flow is switched off in the valve arrangement 13.

The invention has been described in detail with particular reference to certain preferred embodiment thereof, but it will be understood that variations and modifications can be effected within the spirit and scope of the invention.

What is claimed is:

1. A device for assembly of tubular cylindrical carriers (8) on a carrier cylinder (1) having a lateral surface (22) and flat surface (21, 23), a pressure medium acting on said lateral surface (22) for facilitating assembly of the tubular carrier (8) on said lateral surface, comprising an assembly aid (4), having a lateral surface which is capable of holding a tubular cylindrical carrier (8), a pressure medium operatively associated with such lateral surface (22) of said carrier cylinder (1) such that positioning of the tubular carrier (8) is made possible, switch elements (6, 11, 13, 15) for switching a pressure medium on and off provided in said carrier cylinder (1) and said assembly aid (4), said switch elements respectively located so as to switch said pressure medium on as said assembly aid approaches said carrier cylinder and a sensor element on said carrier cylinder for detecting the presence of the tubular carrier on said carrier cylinder and in response to said presence being detected, acting on said switch elements to change a volume flow of the pressure medium.

2. The device according to claim 1, wherein outlet openings (9, 10) for the emergence of the pressure medium, are respectively associated with said lateral surface of said carrier cylinder and said assembly aid and are supported with pressure medium upon flat surface contact of said carrier cylinder and assembly aid.

3. The device according to claim 2, wherein a sensor element is held in one of said outlet openings (9, 10), which acts on said switch elements of said carrier cylinder in the case of an assembly aid (4) attached thereto, in such a way that the volume flow of said pressure medium increases from a first volume flow strength to a second volume flow strength.

4. The device according to claim 1, wherein the assembly aid (4) may be centered on a bearing pin (2, 20) of said carrier cylinder (1).

5. The device according to claim 4, wherein said assembly aid (4) contains a covering (7) overlapping a ring slot (25) with said lateral surface.

6. The device according to claim 5, wherein said outlet opening (10) opens into said ring slot (25) under said covering (7).

7. The device according to claim 4, wherein said receptacle (5) aligns with an opening (24) defined in a fiat surface of said assembly aid (4).

8. The device according to claim 4, wherein said assembly aid (4) is provided with a receptacle (5) for a bearing pin (2, 20) serving as a centering element.

9. The device according to claim 8, wherein said receptacle (5) passes coaxial to the center axis of said carrier cylinder (1) and said assembly aid (4).

10. The device according to claim 8, wherein said receptacle (5) extends parallel to a center axis of said assembly aid (4) and said bearing pin (2, 20) serves as a centering element.

11. The device according to claim 1, wherein said assembly aid (4) includes an operating element (6), which in the case of contact with the carrier cylinder (1), penetrates the flat surface (23) of said carrier cylinder to cause a pressure medium to emerge.

12. The device according to claim 11, wherein said operating element (6) is operable in an axial direction.

13. The device according to claim 11, wherein said operating element (6) operates a valve arrangement (13) in the case of attachment of said assembly aide (4) on the flat surface (23) of the carrier cylinder (1) functioning as a thrust bearing surface (31).

* * * * *